US007255590B2

(12) United States Patent
Schremmer et al.

(10) Patent No.: US 7,255,590 B2
(45) Date of Patent: Aug. 14, 2007

(54) PLUG CONNECTOR DEVICE FOR MULTICORE FLAT CABLES

(75) Inventors: Andreas Michael Schremmer, Berglen (DE); Tobias Schimmele-Breff, Weinstadt (DE); Manfred Illg, Weinstadt (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/442,059

(22) Filed: May 25, 2006

(65) Prior Publication Data

US 2006/0240701 A1 Oct. 26, 2006

Related U.S. Application Data

(63) Continuation-in-part of application No. PCT/EP2004/013438, filed on Nov. 26, 2004.

(30) Foreign Application Priority Data

Dec. 22, 2003 (DE) ..... 203 19 849 U

(51) Int. Cl.
*H01R 4/24* (2006.01)

(52) U.S. Cl. ..... 439/404

(58) Field of Classification Search ..... 439/404, 439/405, 417, 660, 395, 587, 272
See application file for complete search history.

(56) References Cited

U.S. PATENT DOCUMENTS

| | | | | |
|---|---|---|---|---|
| 4,026,625 | A * | 5/1977 | Roiko et al. | 439/405 |
| 4,484,791 | A * | 11/1984 | Johnson | 439/404 |
| 4,674,819 | A | 6/1987 | Fujitani et al. | |
| 4,676,576 | A | 6/1987 | Feldberg et al. | |
| 4,711,509 | A | 12/1987 | Cross et al. | |
| 5,064,382 | A | 11/1991 | Minnis | |
| 5,242,313 | A * | 9/1993 | Logerot et al. | 439/404 |
| 6,039,596 | A * | 3/2000 | Whiteman et al. | 439/404 |
| 6,273,729 | B1 * | 8/2001 | Kelly | 439/36 |
| 6,641,436 | B2 * | 11/2003 | Baffert | 439/582 |

FOREIGN PATENT DOCUMENTS

| | | |
|---|---|---|
| DE | 31 12 362 C2 | 8/1984 |
| DE | 31 12362 C2 | 8/1984 |
| DE | 43 088 664 A1 | 9/1993 |
| DE | 48 08 664 A1 | 9/1993 |
| DE | 690 03 938 T2 | 2/1994 |
| FR | 2 635 417 | 2/1990 |

* cited by examiner

*Primary Examiner*—James R. Harvey
*Assistant Examiner*—Travis Chambers
(74) *Attorney, Agent, or Firm*—Peter Van Winkle

(57) ABSTRACT

A plug connector device (10) for multicore flat cables (15), has a plug (11) which can be fixedly joined to one end of a flat cable in a mechanical fashion, and a plug socket (12) which can be run through by the flat cable (15) such that, with their first contact ends (62), contact elements of the plug socket (12) engaging in the plug (11) can be electronically connected to the flat cable at their other contact ends (63) using IDC technology. To assure that the plug connector device is robust and has high contacting reliability, provision is made that plug (11) is provided with contact elements (18), whose first contact ends (38) are configured for the electrical connection to the first contact ends (62) of the contact elements (19) of the plug socket (12), and whose other contact ends (36) are configured for the connection to the flat cable (15) using IDC technology.

7 Claims, 5 Drawing Sheets

PLUG CONNECTOR DEVICE FOR MULTICORE FLAT CABLES

CROSS-REFERENCE TO RELATED APPLICATION

This is a Continuation-In-Part of PCT/EP2004/013438 filed 26 Nov. 2004, which designated the US and which claimed priority from German patent application 203 19 849.2 filed 22 Dec. 2003.

BACKGROUND OF THE INVENTION

The present invention relates to a plug connector device for multicore flat cables.

Connector devices of this type are used in connection with multicore flat cables, for example, in designing a network of components out of doors such as detonators for civilian explosions, such that these components can be driven in a controlled manner both spatially as well as temporally via the flat cable and the plug connector devices. For this purpose, the plug connector devices must be not only robust but also sealed, so that they maintain the electrical connection, i.e., the contact, under any circumstances.

In one known plug connector device of this type, the plug socket at the insertion end of its cylindrical plug receptacle has a partition that is fitted with contact elements that are arranged in an upright position, the contact elements, on the one hand, extending beneath the partition into a flat cable receiving space and, on the other hand, extending into the receiving space for the plug. In this context, both ends of the contact elements are executed using IDC technology, which means that in the space between the partition and the base, both ends are electrically connected to the flat cable, which passes through this space, i.e., to its individual cores. In this context, the other contact end is also produced using IDC technology. The plug of this known plug connector device has a cylindrical hollow space, in which the flat cable is inserted in a li-shape, abutting the interior side of a base of this hollow space.

The end in question of the flat cable is mechanically fixed in position by a support that is introduced into the cylindrical hollow space. From the exterior side of the plug, the base is provided with recesses, through which the other contact ends of the contact elements executed using IDC technology extend, thus being able, in the plug, to contact the cores of this inserted end of the flat cable.

One disadvantage of this known plug connector device, apart from the insufficient seal, is the fact that the contacting of the plug connector device is not as reliable as might be hoped, because the assignment of contact bore holes in the plug, on the one hand, and the configuration of the IDC contact ends, on the other hand, must be very precise due to the minimal flexibility and elasticity of the individual contact surfaces.

SUMMARY OF THE INVENTION

It is an object of the present invention, to provide a plug connector device that is robust and has great contacting reliability for multicore flat cables of the type mentioned above.

As a result of the measures according to the present invention, a reliable contacting between plug and plug socket is achieved due to the use of additional contact elements in the plug. Therefore, the IDC technology is used only where a check test is possible after the flat cable is mounted on the plug or plug socket, but not for achieving the plug connection in designing an appropriate drive network for the devices in question, e.g., detonators.

The invention provides for simple adjustments of the contact elements of plugs and plug sockets to the various positions of the individual cores of the flat cable.

The contact elements of plugs and plug sockets can be easily manufactured.

A robust and reliable type of contacting between the plug and the plug socket is assured, the more so since it is a contacting that has been proven effective in other plug connector devices.

A robust and sealed configuration of the plug and of the plug socket is provided by the design of the specific plastic housing.

In this context, on the one hand, it is assured that the specific contact elements can be introduced into the housing from one side and that, on the other hand, the flat cable in the plug socket housing has sufficient tensile strength and the plug connection itself is especially well sealed from humidity.

As a result of the possibility of introducing the contact elements of the plug and the plug socket from one end or one side of the housing, it is possible to provide the plug and the plug socket with an individually selected covering through the contact elements.

The present invention also relates to a unit made up of a plug connector device, having a multicore flat cable. This makes possible a very simple drive network that can be set up on virtually any surface for specific devices, such as detonators.

Further details of the present invention can be derived from the following description, in which the present invention is described and explained in greater detail on the basis of the exemplary embodiment that is depicted in the drawing.

DESCRIPTION OF THE PREFERRED EMBODIMENT

Figure 1:
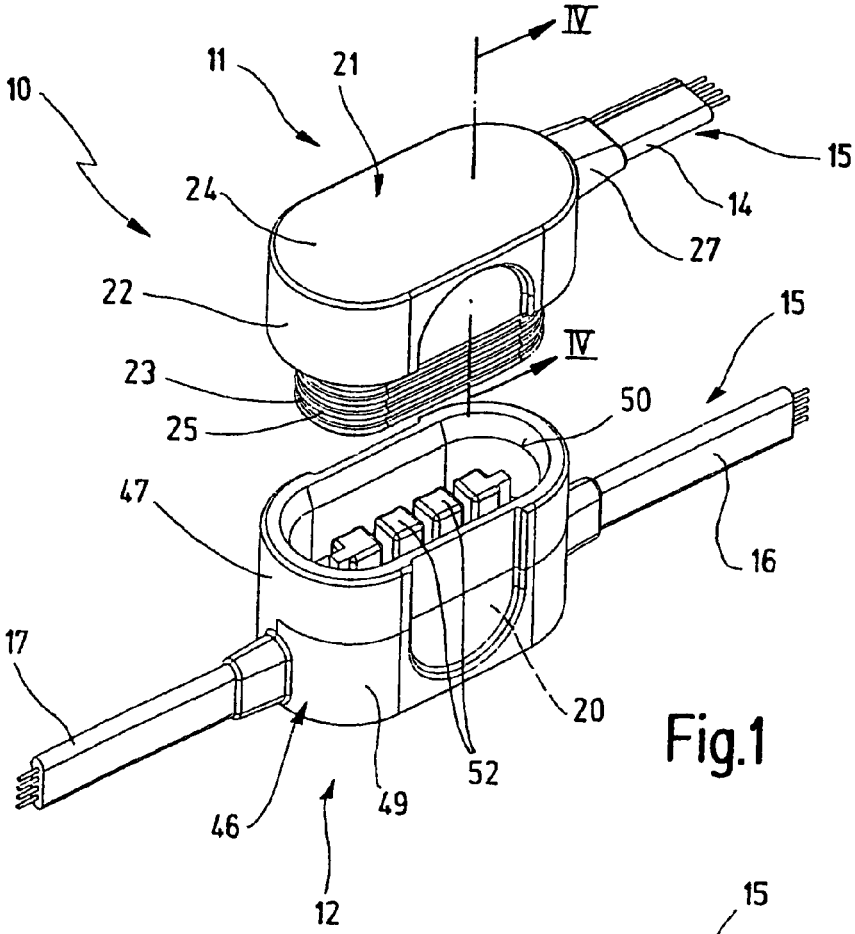
FIG. 1 depicts a plug connector device, including a flat cable, according to one preferred embodiment of the present invention, in the unplugged state.

A plug connector device 10 that is depicted in the drawing in accordance with one preferred exemplary embodiment has a plug 11 having electrical contact elements 18, and a plug socket 12 having electrical contact elements 19, which are configured to produce a sealed, robust, and contact—reliable electrical connection. Plug 11 is mechanically and electrically connected to an end section 14 of a multicore flat cable 15, in this case, having four cores, whereas plug socket 12 receives flat cable 15 in a slide-through arrangement, so that a lead-in section 16, a-lead-out section 17, and a contact section 20 are created in accordance with FIGS. 1 and -1. In a manner that is not depicted in detail, a unit is made up of a plug connector device 10, in the form of plug 11 and plug socket 12, which are arranged separately 17 from each other and are not to be connected to each other, and a flat cable 15, such that end section 14, which leads into plug 11, over a longer or shorter piece of flat cable 15 passes over into lead-in section 16 of a plug socket 12, and then in contact section 20 is connected to plug socket 12 and after lead-out section 17 and a further longer or shorter piece of flat cable 15 proceeds to an undepicted device to be driven, such as a detonator. A plurality of units of this type can be connected to form a network of devices to be driven, for example detonators, such that plug socket 12 of a first unit can be connected to a plug 11 of a second unit of plug connector device 10, etc.

Plug 11 has a housing 21 made of thermoplastic elastomer, the housing being designed to include in one component a base part 22 and a plug part 23. Plug housing 21 in a top view is roughly in the shape of a somewhat elongated rectangle having rounded off ends. In comparison to base part 22, which is provided with a bottom 24, plug part 23 is smaller in overall surface, i.e., it is both shorter as well as narrower. Plug part 23 has a plurality of sealing ribs 25 that are axially arranged next to each other and are situated on the exterior periphery.

Figure 2:
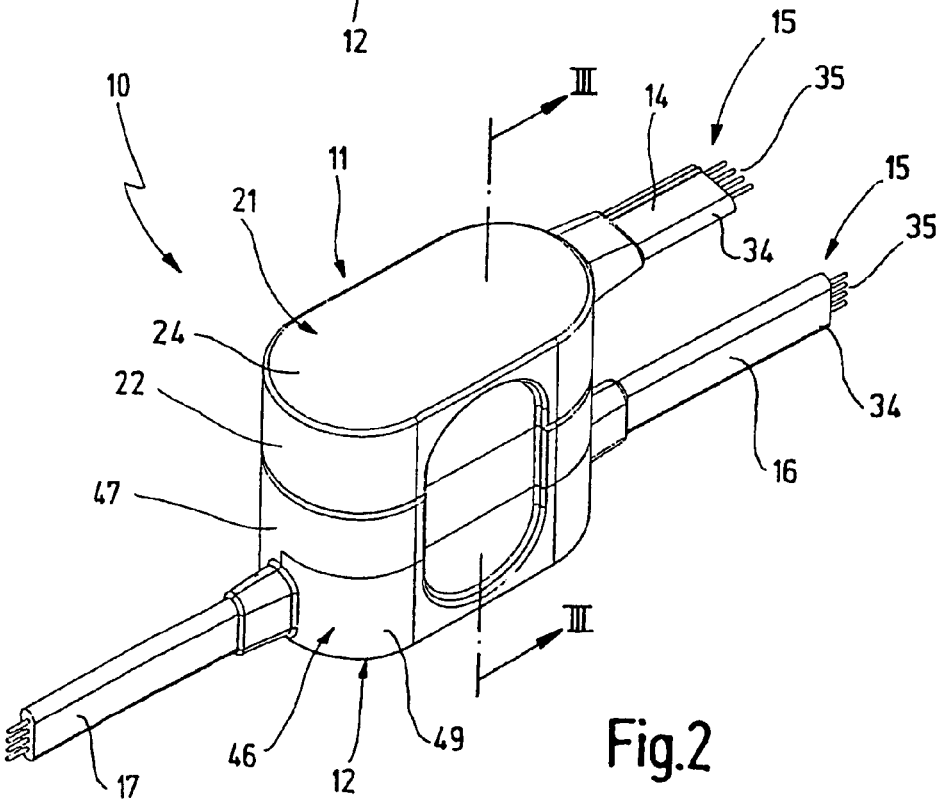
FIG. 2 depicts the plug connector device according to FIG. 1, in the plugged-in state.

Base part 22 from the point of view of a narrow side is provided with a somewhat elongated oval blind hole recess 26, which runs parallel to bottom 24 and ends before the opposite end of base part 22. The cross section of recess 26 corresponds roughly to the cross section of flat cable 15; this means that end section 14 of flat cable 15 is inserted into base part 22 of plug housing 21 up to the end of blind hole recess 26. According to FIGS. 1 and 2, in a manner that is not depicted in detail, a bushing 27 is molded onto base part 22, the bushing being able to hold inserted flat cable 15 in a friction-locking manner for strain relief.

Plug part 23 at its free end surface 28 facing away from base part 22 is provided with a plurality of cutouts 29 that are arranged in longitudinal extension next to each other and that extend from end surface 28 through plug part 23 into base part 22 and terminate in flat cable blind hole recess 26. In the area of plug part 23, cutouts 29 are rectangular, almost square, and in the area of base part 22 pass over into narrower slot-shaped openings. Cutouts 29 on one side have a bar-like offset 31 that runs axially, and that, like slotshaped cutout extension 31, receives in each case one part of contact elements 18 of plug 11.

Contact elements 18 of plug 11 have a first contact end 36, or termination end (FIG. 5) that is produced using IDC (Insulation Displacement Contact) technology to create the electrically contacting connection with relevant cores 35 of flat cable 15, as well as a second contact end 38 that faces away from this first contact end 36 and that functions to provide the electrically contacting connection to the relevant part of contact element 19 of plug socket 12. This second contact end 38, arranged in plug part 23, is configured as a sliding contact having elastic spring properties. The second contact (18. FIG. 4) has a free mating end 38 that is biased toward engaging a corresponding contact mating end 62 (FIG. 3) and is deflectable as the contacts slide together. The first contact 19 (FIG. 6) has a mating end 62 that is fixed to the socket housing 46. Between first contact end 36 and second contact end 38, a connecting part 37 or 37' or 37", etc., is arranged, which has a specific width, depending on the position of core 35 of flat cable 15 that is to be contacted. In other words, connecting part 37, 37', 37", in extension of a longitudinal edge, is provided with axially protruding first contact end 36 and, on its opposite longitudinal edge, is provided with axially protruding first contact end 36 and, on its opposite longitudinal edge in an area diametrically opposite this first contact end 36, is provided with second contact end 38, which is bent at a 90° angel from the plane of connecting part 37. Each contact element 18 is stamped from one metal piece as a single piece and is imprinted. First contact end 36 (FIG. 5), which is configured using IDO technology and is situated in the plane of connecting part 37, has the shape of two parallel prongs 39, which are provided with a cutting point and form between themselves a contacting slot 41 to receive a core 35 of flat cable 15. Depending on the position of core 35, 35', 35", etc., of flat cable 15, connecting part 37, 37', 37", etc., is configured so as to be correspondingly wide, i.e., contact ends 36 and 38, which axially face away from each other, have a correspondingly selected distance [from each other] in the transverse direction of contact element 18.

Figure 4:
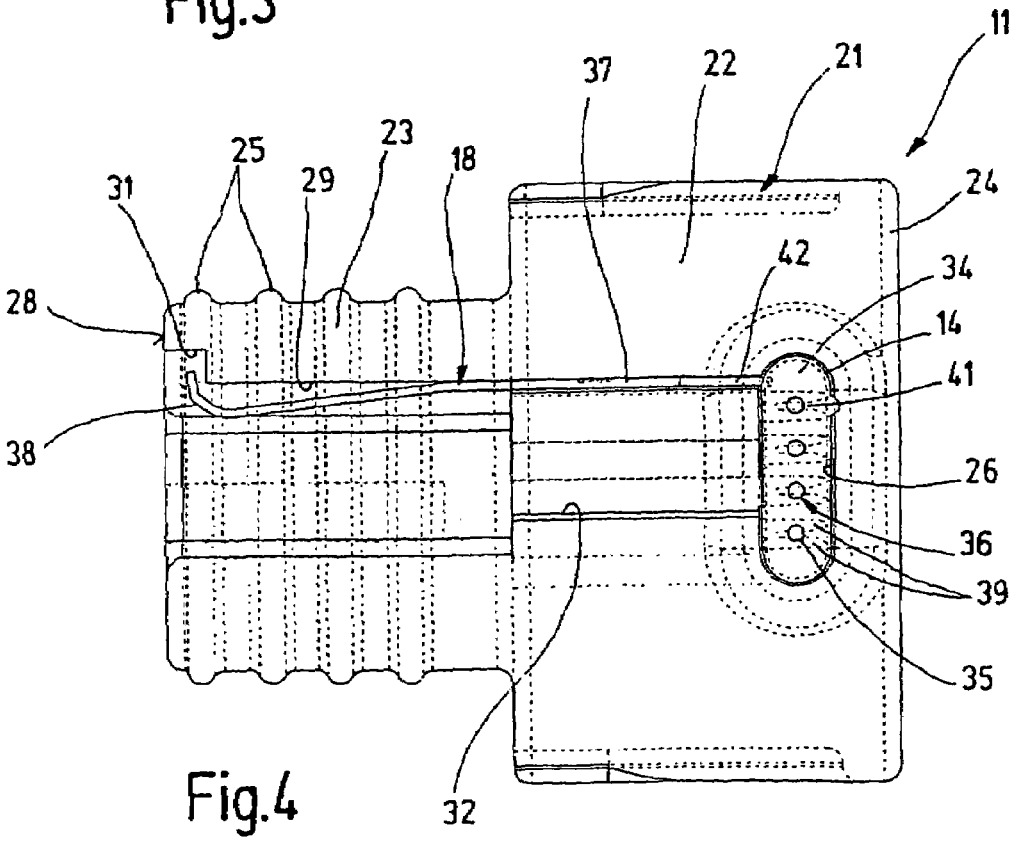
FIG. 4 depicts a sectional view along the line IV-IV in FIG. 1.
Figure 5:
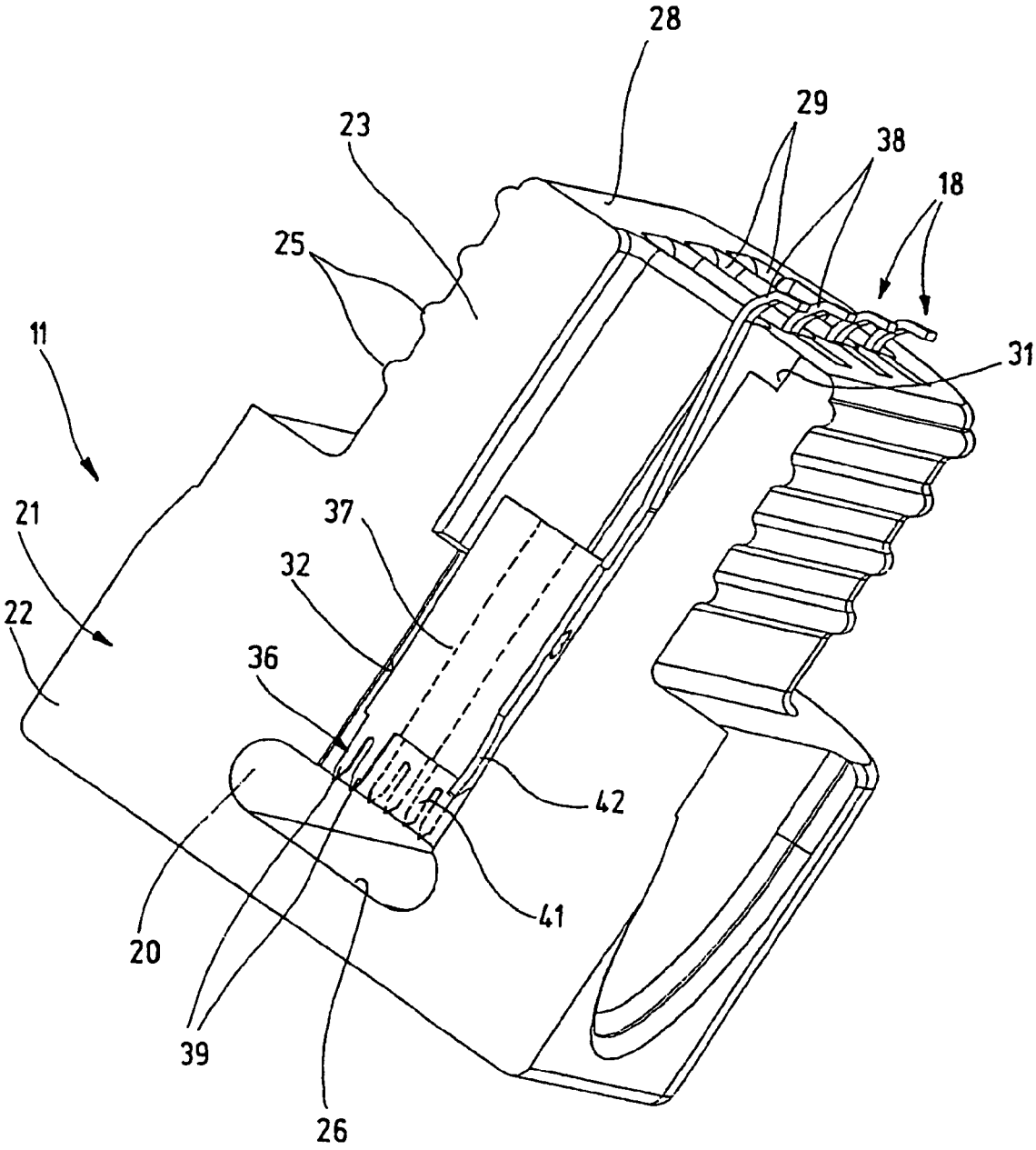
FIG. 5 in a perspective cutaway view depicts the plug of the plug connector device according to FIG. 1, but in a state during the assembly of the contact elements.

As can be ascertained from FIG. 5, individual contact elements 18, 18', 18", etc., are inserted into identically configured cutouts 29 of plug housing 21, until they contact insulation 34 of flat cable 15. Thereupon, the contact elements are inserted further so that IDC contact ends 36 extend through prepared bore holes in insulation 34 of flat cable 15 and, in their contact slots 41, receive relevant core 35, 35', 35", etc., between themselves 17 in an electrically contacting manner (FIG. 4). In this assembled position, sliding contact ends 38 are situated in offsets 31 of cutouts 29. As can also be ascertained from FIGS. 4 and 5, at least one of contact elements 18, 18', 18", in extension of second contact end 38 and parallel to first contact end 36, has a holding-down clamp 42, which functions as an insertion limit stop and which in the assembled state sits on a longitudinal area of insulation 34 of flat cable 15.

Plug socket 12 has a two-part housing 46, whose main component integrally includes a plug receiving part 47 and a lead-in lower part 48 for receiving flat cable 15. The second component is formed by a cover 49, which constitutes the lead-in upper part and which covers the lead-in for flat cable 15 and seals it off by being welded to lead-in lower part 48.

Figure 6:
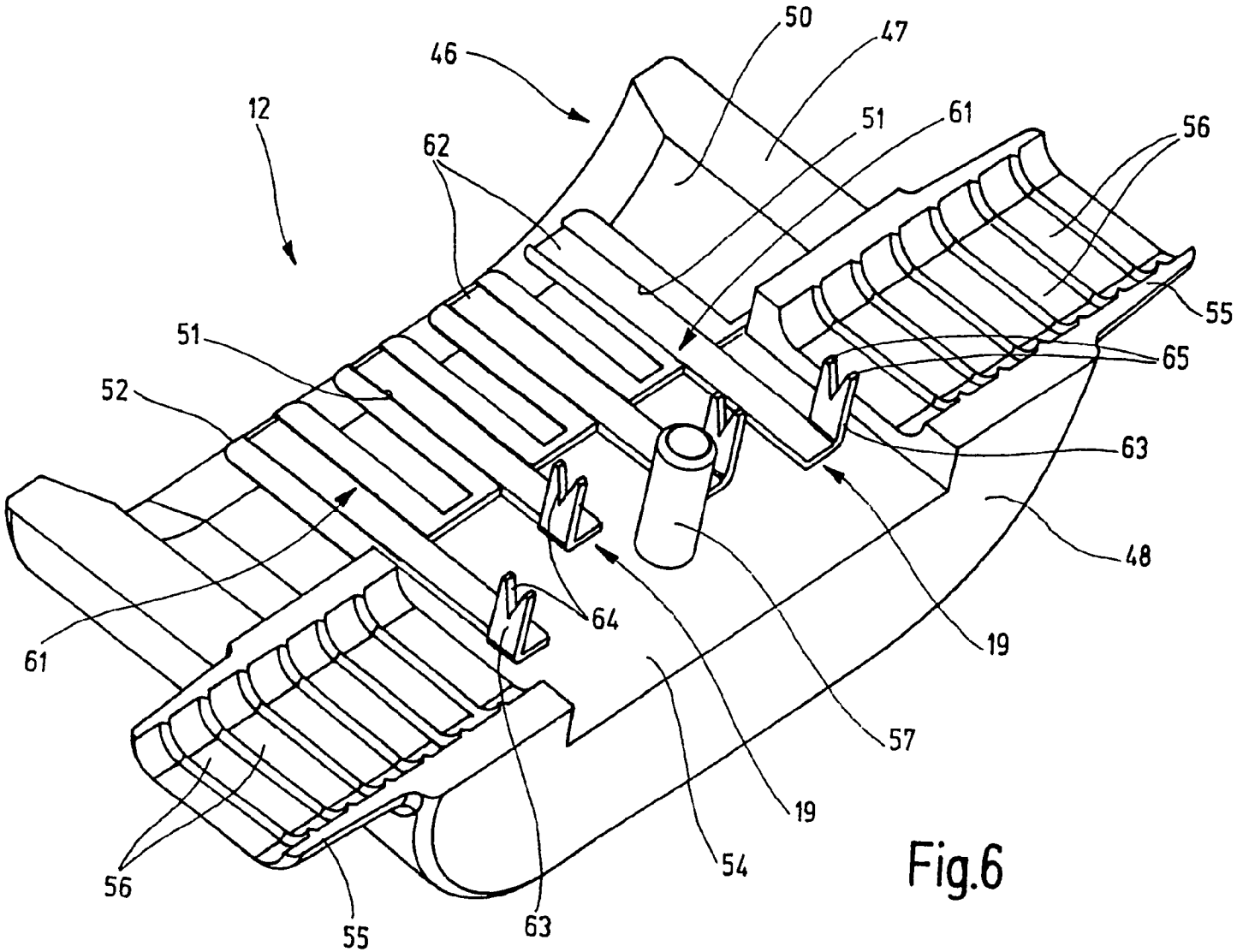
FIG. 6 in a perspective partially cutaway view depicts the plug socket having exposed contact elements of the plug connector device-according to FIG. 1.

In FIG. 6, the main component is shown in a cutaway view in the area of plug receiving part 47. From FIG. 6, together with FIGS. 1 and 8, it can be seen that plug socket housing 46 also has, overall, an elongated rectangular shape with rounded off ends and that plug receiving part 47 has an oval recess 50, for receiving plug part 23 of plug housing 21, and plug projections 52 that are arranged centrally in the longitudinal direction next to each other and that fit into cutouts 29 in plug part 23 of plug housing 21. Plug projections 52 go from bottom 53 of plug receiving part 47, which separates plug receiving part 47 from lead-in lower part 48. Lead-in lower part 48 has a bearing surface 54 that is connected on both sides to a lead-in half shell 55, which is provided with strain-relief ribs 56. In the exemplary embodiment depicted, in bearing surface 54 an insulating pin 57 is molded that is arranged in perpendicular fashion. Contact elements 19 of plug socket 12 have a flat contact bar 61, 61', and 61", etc., which, at its second contact end 62, which is arranged in the area of plug projections 52, functions to contact relevant sliding contact end 38 of contact elements 18 of plug 11. The end of contact bar 61, 61', 61", etc., facing away from this second contact end 62 is configured having a first contact end 63 using IDC technology. This IDC contact end 63 extends at a longitudinal edge area of contact bar 61 and perpendicular to its longitudinal direction. Contact bar 61 is configured in one piece, IDC contact end 63 being bent at a right angle. As can be discerned from FIG. 6, contact bars 61, 61', 61", etc., are arranged such that IDC contact ends 63 protrude at right angles from bearing surface 54 of lead-in lower part 48 and, because contact bars 61, 61', 61", etc., are of varying lengths in accordance with the position of cores 35 of flat cable 15 to be contacted, they are provided in various parallel positions on surface 54. In the exemplary embodiment depicted, for example, IDC contact ends 63 of first and fourth contact bars 61 are situated in alignment with insulating pin 57, whereas IDC contact ends 63 of both contact bars 61' and 61" are situated in parallel lines that are different therefrom. In a manner that is not depicted in detail, plug projections 52 are provided with a channel 51, and bottom 53 of plug socket housing 46 is provided with slots 64 that terminate in channels 51, through which contact bars 61, 61', 61" can be led in from the side of bearing surface 54 of lead-in lower part 48, until at their first contact ends 62, which are slightly bent to the inside, they come to rest in an offset on plug projection 52, so that they reach the position depicted in FIG. 6.

Figure 7:
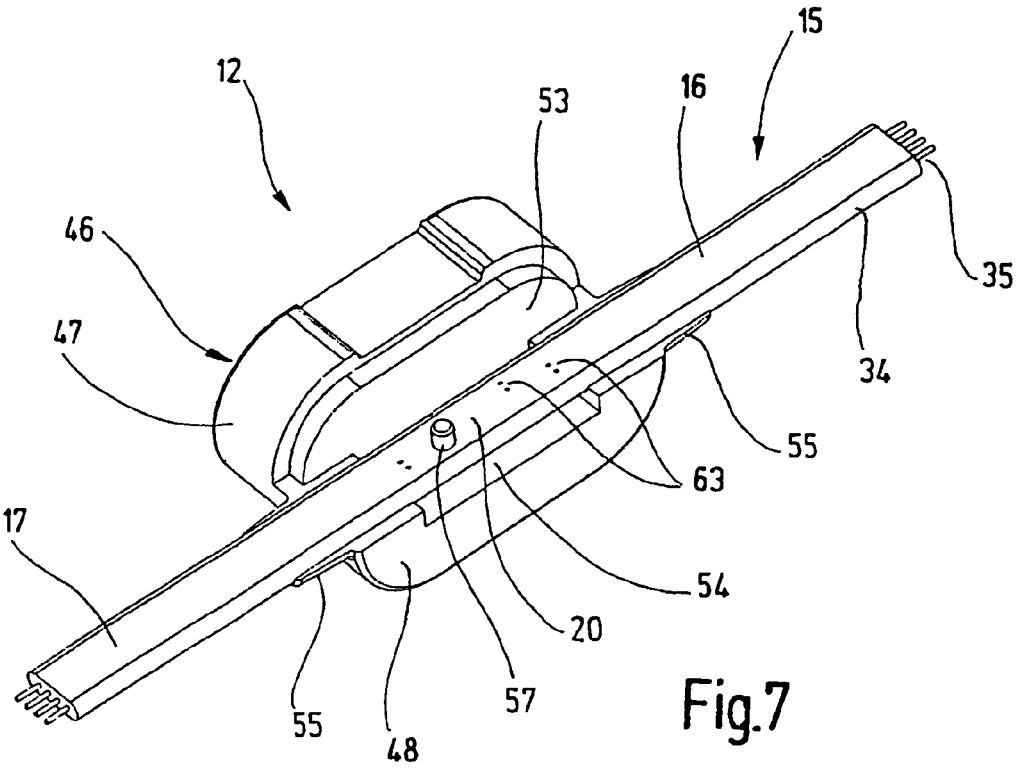
FIG. 7 in a perspective view depicts the plug socket of the plug connector device after the assembly of contact elements and flat cable, but before the attaching of the cover part.

In the assembled position represented in FIG. 6, flat cable 15, in the manner shown in FIG. 7, is placed onto lead-in lower part 48, IDC contact ends 63 being pressed through prepared bore holes in insulation 34 of flat cable 15 and being visible on the other side of flat cable 15. The same applies to insulation pin 57, which penetrates a bore hole in flat cable 15, this bore hole severing one core 35" of flat cable 15. While fourth core 35'" in the exemplary embodiment depicted is led through plug socket 12 without contacting and without being separated, other cores 35, 35', 35" are held in IDC contact ends 63 in an electrically contacting manner. In this context, IDC contact ends 63 are provided with V-shaped contact surfaces between two prongs 65.

Figure 8:
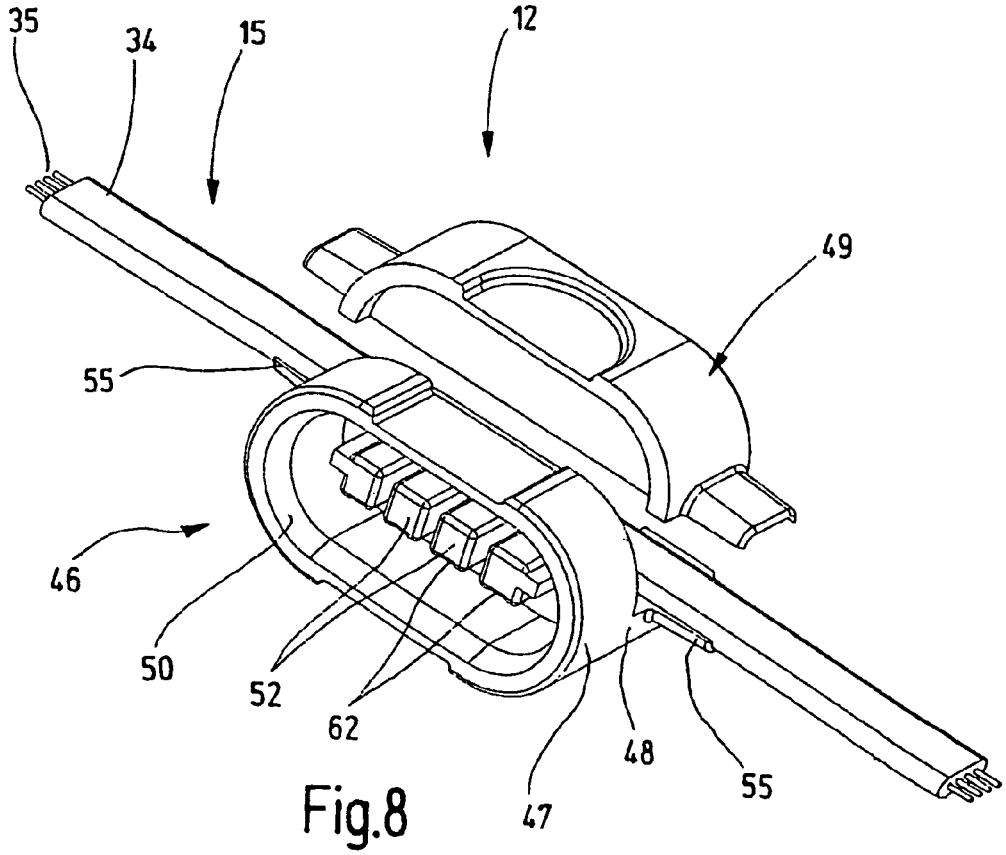
FIG. 8 depicts a perspective view similar to that of FIG. 7, with the cover part still off.

After this assembly procedure, in accordance with FIG. 8, the cover, or lead-in upper part 49, is placed onto lead-in lower part 48 and is welded to it and to plug receiving part 47 all around. Due to the through holes and due to insulation pin 57, arranged so as to be offset in the transverse extension, strain relief for flat cable 15 is provided, along with assuring the non-invertability of flat cable 15.

Figure 3:
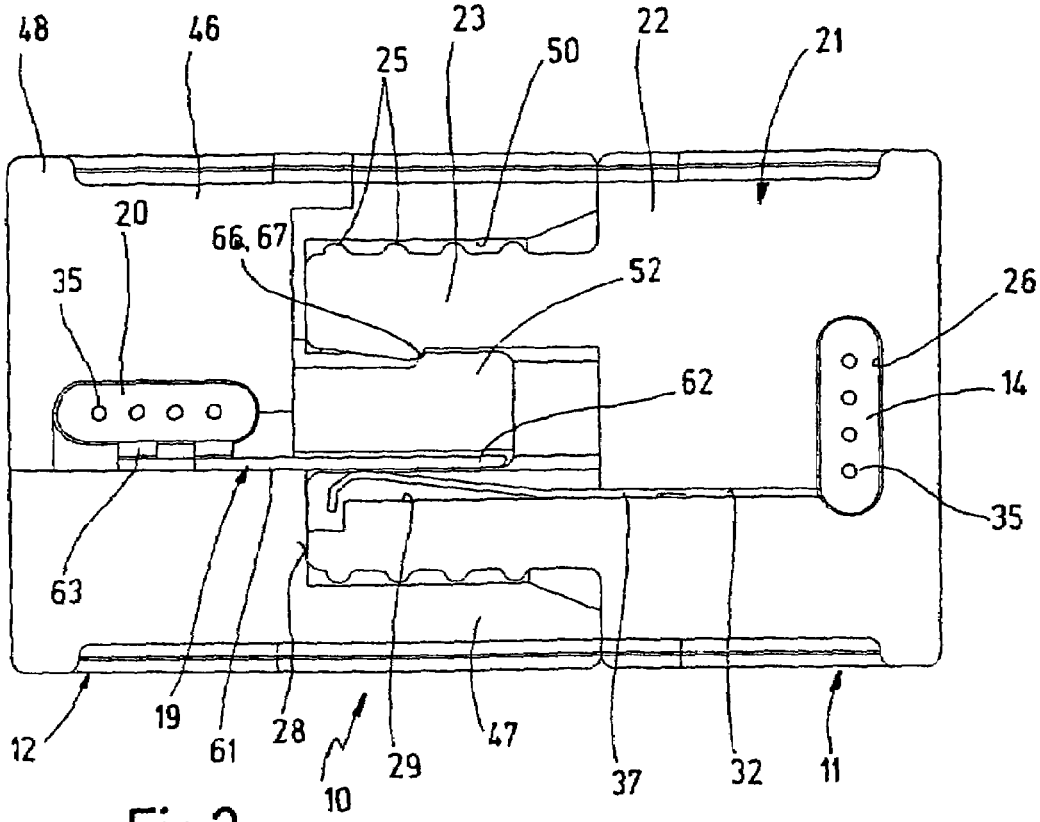
FIG. 3 depicts a sectional view along the line III-III in FIG. 2.

As can be derived from FIG. 3, when plug 11 is inserted into plug socket 12, the plug connection is not only sealed due to ribs 25 of housing 21, which is made of thermoplastic, the ribs correspondingly contacting the interior wall of recess 50 of plug receiving part 47 of plug socket 12 in a sealing manner, but the plug connection also forms a mechanical latch due to an interior circumferential offset 66 within plug part 23 of the plug and a corresponding projection 67 on one or more of plug projections 52.

As can be seen from the design of contact elements 19 and 19 and that of the recesses of plug housing 21 and plug socket housing 46 that receive these contact elements 18 and 19, contact elements 18 and 19, which are employed for contacting selected cores 35 of flat cable 15, can be selected and employed in any fashion. In other words, the plug and plug socket 12 can be equipped in varying ways in accordance with the desired circuitry of individual cores 35 of flat cable 15. Therefore, in contrast to the exemplary embodiment depicted, contact elements 18 having varyingly wide connecting parts 37 and/or contact elements 19 having their contact bars 61 of different lengths can be introduced in the housing in question in any conceivable arrangement, one behind the other, in plug 11 and in plug socket 12.

Of course, plug connector device 10 can also be configured for fewer or more cores 35 of flat cable 15 than the four that are depicted here.

What is claimed is:

1. A plug connector device (10) for multicore flat cables (15) including a plug (11) which can be fixed to one end of a flat cable and including a plug socket (12) through which a flat cable (15) can extend with contact elements of the plug and plug socket (12) having mating ends engaging each other, and with said contact elements of said plug and plug socket having termination ends connected to the flat cables using IDC technology, wherein:

said plug (11) has a plug housing (21) formed of an integral quantity of elastomer and has a base (22) and a narrower plug part (23) opposite it, and the base (22) at one of its ends (14) has an elongated blind hole recess (26) for inserting one end of a flat cable (15), the plug part (23) having insertion receptacles (29) for the contact elements (18) that extends from the base part in a direction perpendicular to the direction of elongation of the blind hole recess in the base (22).

2. The plug connector device as recited in claim 1, wherein:

the insertion receptacles (29) in the plug part (23) for the contact elements (18) extends from an end face of the plug part (23).

3. The plug connector device as recited in claim 1, wherein:

the plug part (23) of the plug housing (21) is provided on the exterior circumference with circumferential sealing ribs (25).

4. The plug connector device as recited in claim 1, wherein:

the plug housing (21) is configured as a soft molded body made of a thermoplastic elastomer.

5. The plug connector device as recited in claim 4 wherein:

of the plug and plug socket, one of them has upper and lower parts with a lead-in opening to the termination ends of said contacts, with one of said parts having a molded pin (57) that protrudes in perpendicular fashion from a cable contact surface (54).

6. The plug connector device as recited in claim 5, wherein:

the pin (57) is arranged outside of the center line of the flat cable (15).

7. The plug connector device as recited in claim 1, wherein:

between a support (52) for the contact elements (19) on the plug socket housing (46) and a contact element receptacle (29) on the plug part (23) of the plug housing (21), latching undercuts (66) and latching projections (67), respectively, are provided.

* * * * *